United States Patent [19]

Lane

[11] Patent Number: 5,072,351

[45] Date of Patent: Dec. 10, 1991

[54] CLAMPING DEVICE FOR RETAINING A GLASS NEON TUBE ONTO A GLASS TUBE SUPPORT

[76] Inventor: Robert F. Lane, 3334 Burton Ave., Burbank, Calif. 90504

[21] Appl. No.: 634,751

[22] Filed: Dec. 24, 1990

[51] Int. Cl.[5] ..... F21V 21/00

[52] U.S. Cl. ..... 362/396; 248/50; 362/263

[58] Field of Search ..... 362/216, 217, 263, 382, 362/386; 248/50

[56] References Cited

U.S. PATENT DOCUMENTS

| | | | |
|---|---|---|---|
| 2,050,559 | 8/1936 | Budnick | 248/50 |
| 2,254,706 | 9/1941 | Mueller . | |
| 2,390,385 | 12/1945 | Pooler | 248/50 |
| 2,545,416 | 3/1951 | Staaf | 248/50 |
| 2,645,831 | 7/1953 | Staaf | 248/50 |
| 2,767,946 | 10/1956 | Weeks | 248/50 |
| 2,850,560 | 9/1958 | Heyob et al. | 248/50 |
| 2,885,538 | 5/1959 | Mahon . | |
| 4,122,511 | 10/1978 | Petersen . | |

FOREIGN PATENT DOCUMENTS

| | | |
|---|---|---|
| 107958 | 7/1939 | Australia . |
| 684186 | 8/1951 | United Kingdom . |

*Primary Examiner*—Ira S. Lazarus
*Assistant Examiner*—Richard R. Cole
*Attorney, Agent, or Firm*—Thomas I. Rozsa

[57] ABSTRACT

One embodiment of the present invention clamping device comprising a clamp made of resilient metal having a pivot portion inserted into a hole on a glass tube support and a clamp portion generally adapted to the size and shape of part of the outer circumference of a glass neon tube. Another embodiment of the present invention comprising a first member mounted to a glass tube support without a hole and a second member attached to the first member and also having a clamp portion generally adapted to the size and shape of part of the outer circumference of a glass neon tube. The clamp portion of the different embodiments of the present invention can be rotated about a longitudinal axis parallel to the glass neon tube and clamped onto part of the outer circumference of the glass neon tube to securely retain the glass neon tube onto the glass tube support.

15 Claims, 3 Drawing Sheets

Fig. 1. (PRIOR ART)
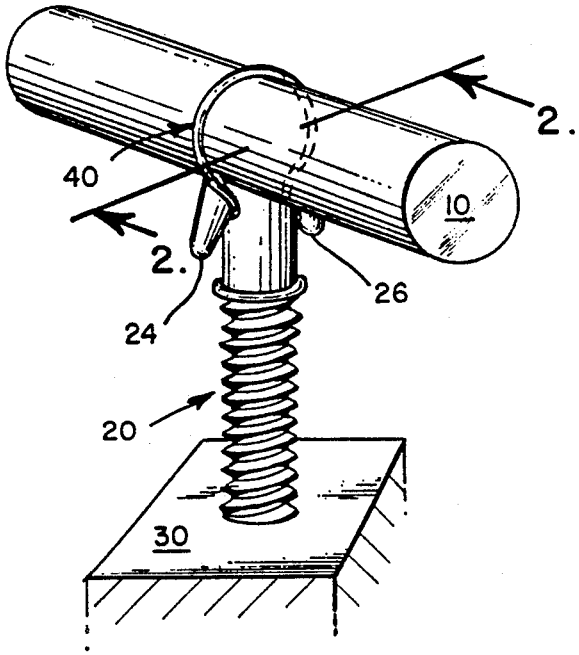
Fig. 2. (PRIOR ART)
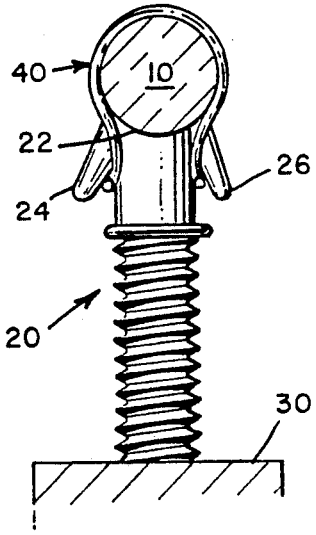
Fig. 4.
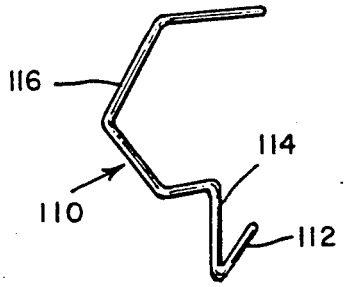
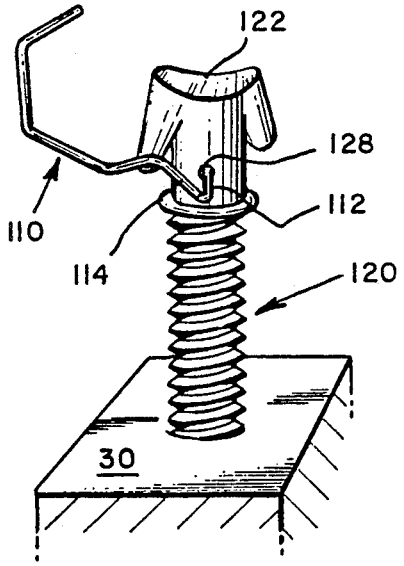
Fig. 3.
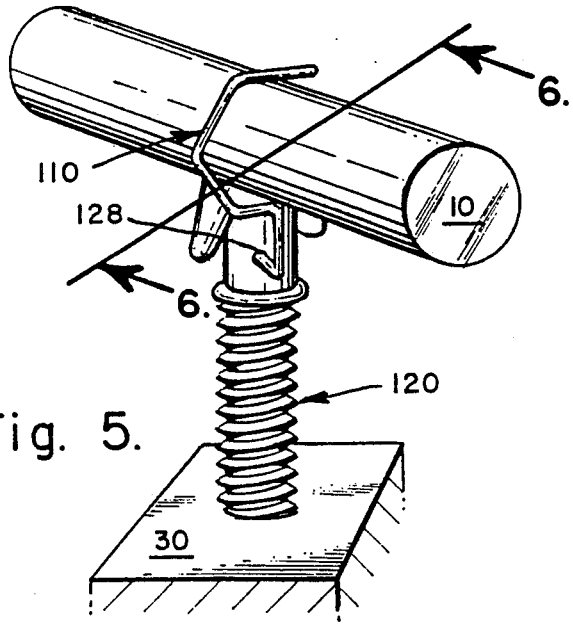
Fig. 5.

Fig. 10.
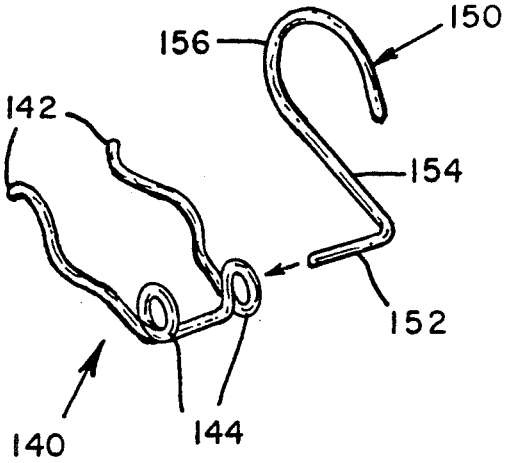
Fig. 11.
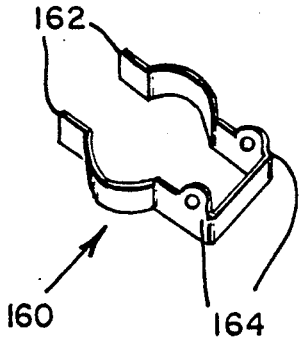
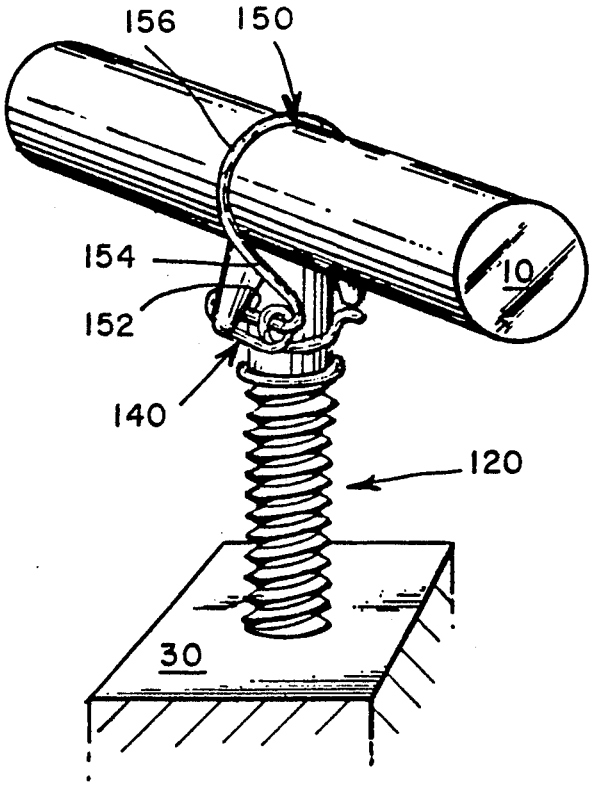
Fig. 12.

CLAMPING DEVICE FOR RETAINING A GLASS NEON TUBE ONTO A GLASS TUBE SUPPORT

BACKGROUND OF THE INVENTION

1. Field of the Invention

The present invention relates to the field of glass neon filament constructions for commercial neon signs. More particularly the present invention relates to the field of supporting glass neon tubes with glass tube supports.

2. Description of Prior Art

Glass neon filament constructions have been used for commercial signs for many years. Most typical structures of commercial neon signs use a multiplicity of glass neon tubes connected together. One of the difficult problems in the construction is how to support the glass tubes and hold them into position. Retaining a glass tube onto a tube support is a common issue in the glass tubular lamp industry. The following is a list of the prior art patents which have addressed to this problem.

1. U.S. Pat. No. 4,122,511 issued to Petersen on Oct. 24, 1978 for "Lamp-Shade For Tubular Lamps" (hereafter the "Petersen Patent").

2. U.S. Pat. No. 2,885,538 issued to Mahon et al. on May 5, 1959 for "Neon Tubing Support" (hereafter the "Mahon Patent").

3. British Patent No. 684,186 issued and assigned to The Edison Swan Electric Company Limited on Aug. 29, 1951 for "Improvements In And Relating To Lanterns For Street Lighting" (hereafter the "British Patent").

4. U.S. Pat. No. 2,254,706 issued to Mueller et al. on Sept. 2, 1941 for "Fluorescent Lamp Holder" (hereafter the "Mueller Patent").

5. Australian Patent No. 107,958 issued and assigned to The General Electric Company Limited of England on July 27, 1939 for "Improvements In Lighting Fittings Adapted To Corporate With A Linear Source Of Light" (hereafter the "Australian Patent").

The Petersen Patent discloses a lamp-shade for tubular lamps. The primary concept of the Petersen Patent is to provide a lamp-shade which produces a distribution of light in a preferred manner. It comprises a plurality of cross plates 24 with saw-tooth shaped surfaces on both sides which are primarily used for distributing the light in a preferred manner. In addition each one of plates 24 also has two supporting rods 34 to support the tubular lamp. However the plate structure with saw-tooth shaped surfaces is not only unnecessary but also not applicable for supporting glass neon tubes of commercial neon signs.

The Australian Patent discloses a directional lighting fitting. The primary concept of the Australian Patent is also to provide a lighting fitting which produce a distribution of light with maximum intensity in a preferred direction. Nevertheless the Australian Patent discloses a device combined by a stirrup and a spring for supporting one end of a tubular lamp. The lighting fitting comprises a tubular lamp supported at one end by socket 4 and the other end by stirrup 11 which is closed by spring 12. Spring 12 has both its ends attached to the two outwardly extended ends of stirrup 11 and therefore forms a closed loop around the outer diameter of the end of the tubular lamp.

The British Patent discloses an improved street lighting lantern for an elongated tubular light source. The primary concept of this British Patent is similar to the one of the Australian Patent discussed above. The British Patent also discloses a hook support 25 with a spring to steady the unfastened end of a tubular lamp in the operable position.

The Mueller Patent discloses a fluorescent lamp holder comprising a body provided with spaced contact members for engaging the spaced contact prongs of a fluorescent lamp, and a bail 17 having opposite ends 12 pivotally mounted on opposite sides of the body and having a portion adapted to extend the periphery of the lamp for retaining it in position on the lamp holder. It takes two holders to hold an elongated tubular lamp at its two ends, one at each end of the lamp. The contact prongs at each end of the lamp are inserted into the contact members on the body of the holder at each end respectively. The impinging contact between the prongs at the ends of the lamp and the contact members on the body of the holders, and the inward longitudinal spring effect of the body of the holders at each end of the lamp primarily hold the lamp in position. While this is sufficient to retain the lamp, which is true today, it was felt back in the 1940's that an additional support was needed. Therefore bail 17 was added. As described in the Mueller Patent, two ends 12 of bail 17 are pivotally mounted to the opposite sides of the body of the holder respectively. Bail 17 can be rotated about a transversal axis which is through its two ends 12 and perpendicular to the longitudinal direction of the elongated lamp. Before inserting an end of the lamp into the body of a holder, bail 17 is rotated about the transversal axis into an open position to leave enough clearance for putting the end of the lamp into the body of the holder. After the end of the lamp has been inserted into the body of the holder, bail 17 is rotated back into a locking position so bail 17 with its two ends mounted to the body of the holder forms a closed loop with its extended portion engaged to the outer periphery of the end of the lamp.

Although the Australian Patent, the British Patent and the Mueller Patent all disclose some sort of means for supporting an elongated tubular lamp, it needs to be pointed out that all the supporting means are forming a closed loop around the outer circumference of the tubular lamp. This kind of closed loop arrangement is only suitable for supporting a tubular lamp at the end but not suitable to support an elongated tubular lamp at the middle. This is because without completely detaching either the springs of the Australian Patent and British Patent or the bail of the Mueller Patent to break the closed loop, the middle part of an elongated tube cannot be placed into and enclosed by the closed loop. Therefore these types of supporting means are not suitable for constructing commercial neon signs because they use a lot of elongated glass neon tubes which need to be supported not only at the ends but along everywhere in the middle.

The Mahon Patent discloses a type of neon tube support which addresses this problem. It comprises a supporting clip 22 mounted to a holder. Clip 22 has an end provided with a bifurcated arm structure having arms 44 which diverge away from the shank of clip 22 and converge toward one another so that their ends are located adjacent to but spaced from one another so a portion of an elongated glass tube may be snapped between them. This arrangement can support any portion of an elongated tube because instead of having a closed loop structure, it has an open clipping structure.

There is another type of prior art glass neon tube supporting means widely used today in constructions of commercial neon signs. Referring to FIG. 1 of the prior art, there is shown at 10 a portion of an elongated glass neon tube used for the structure of a commercial neon sign. Tube 10 is supported by a tube support 20 mounted to a base 30. Support 20 is made of glass for isolating purposes. Base 30 may be part of an outside wall or an inclined roof of a building or a backing board or structure of the sign. FIG. 2 is a cross-sectional view taken along line 2—2 of FIG. 1. Support 20 has a depressed top 22 for tube 10 to rest on and two downwardly extended side arms 24 and 26. A flexible wire 40 is wrapped around the outer circumference of tube 10 and two ends of wire 40 are tied to side arms 24 and 26 of support 20 respectively to securely retain tube 10 onto support 20. This type of glass neon tube supporting means can support any portion of an elongated glass neon tube, whether at the end or in the middle. It also has very few simple parts so it is less expensive to produce and easy to maintain. However in practical use of commercial sign construction, using flexible wires to wrap and tie the tube to the supports is very inconvenient and is a very time consuming process. It will be beneficial if there is a clamping device which can be utilized with the current glass tube supports to clamp the outer circumference of an elongated glass tube for retaining the elongated glass tube onto the glass tube support in commercial neon sign constructions.

SUMMARY OF THE PRESENT INVENTION

The present invention is a clamping device for retaining a glass neon tube onto a glass tube support.

It is known that elongated glass neon tubes are often used in constructing commercial neon signs. Many supporting means for supporting elongated tubular lamps in prior art lighting fixtures generally use a closed loop structure for supporting the end of an elongated lamp. In current conventional constructions of glass neon signs, a popular type of glass tube support as shown in prior art FIG. 1 and FIG. 2 is used to provide isolated support to the glass neon tubes. It can support not only the ends but also the middle portion of an elongated glass neon tube. However it requires a lot of wire fastening processes for retaining the elongated glass neon tube onto the glass tube support, which is very time consuming.

It has been discovered, according to the present invention, that if a clamping device is utilized for the current type of glass tube support, then the wire fastening process can be eliminated.

It has also been discovered, according to the present invention, that if the clamping device utilized for the current type of glass tube support also has a portion adapted as an open loop which can enclose at least half of the outer circumference of an elongated glass neon tube, then it can be used at any location of the elongated glass neon tube for retaining the elongated glass neon tube onto the glass tube support.

It has further been discovered, according to the present invention, that if the clamping device with an open loop structure is specially shaped and pivotally mounted to the glass tube support, then it can be rotated to an open position to allow an elongated glass neon tube to be freely placed onto or removed from the glass tube support, as well as a locking position to retain the elongated glass neon tube securely onto the glass tube support.

It is therefore an object of the present invention to provide a clamping device utilized for the current type of glass tube support which eliminates the wire fastening process.

It is an additional object of the present invention to provide a clamping device having a portion adapted as an open loop which can enclose at least half of the outer circumference of an elongated glass neon tube so it can be used at any location of the elongated glass neon tube for retaining the elongated glass neon tube onto the glass tube support.

It is a further object of the present invention to provide a clamping device specially shaped and pivotally mounted to the glass tube support so that it can be rotated to an open position to allow an elongated glass neon tube to be freely placed onto or removed from the glass tube support, as well as a locking position to retain the elongated glass neon tube securely onto the glass tube support.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a schematic diagram showing a prior art arrangement where an elongated glass neon tube 10 is retained by a wire 40 onto a glass tube support 20 mounted to base 30.

FIG. 2 is a cross-sectional view taken along line 2—2 of FIG. 1.

FIG. 3 is a perspective view showing an arrangement of the present invention where a clamping device 110 is pivotally mounted into a small hole 128 on a glass tube support 120, and clamping device 110 is placed in an open position.

FIG. 4 is a perspective view of clamping device 110.

FIG. 5 is a perspective view showing an arrangement of the present invention where clamping device 110 is rotated in a locking position for retaining the elongated glass neon tube 10 onto glass tube support 120.

FIG. 10 is a perspective view of another alternative embodiment of the present invention which has first and second clamping members and can be used with currently available glass tube supports without a hole.

FIG. 11 is a different embodiment of the first clamping member of the alternative embodiment used with glass tube supports without a hole.

FIG. 12 is a perspective view of the alternative embodiment of the present invention used with a glass tube support without a hole.

DETAILED DESCRIPTION OF THE PREFERRED EMBODIMENT

Figure 6:
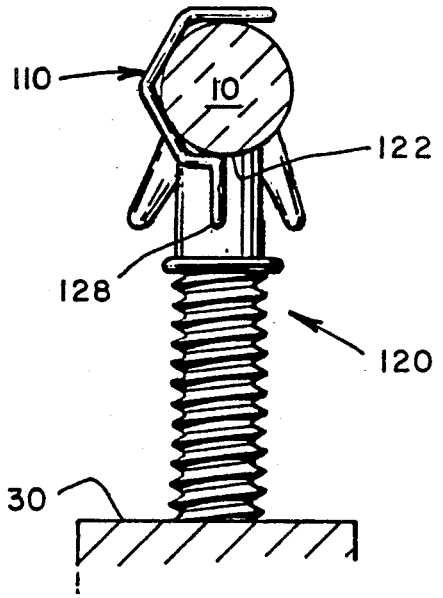
FIG. 6 is a cross-sectional view taken along line 6—6 of FIG. 5.

Although specific embodiments of the present invention will now be described with reference to the drawings, it should be understood that such embodiments are by way of example only and merely illustrative of but a small number of the many possible specific embodiments which can represent applications of the principles of the present invention. Various changes, modifications and uses obvious to one skilled in the art to which the present invention discloses are deemed to be within the spirit, scope and contemplation of the present invention and as further defined in the appended claims.

Referring to FIG. 3, there is shown at 110 a clamping device of the present invention pivotally mounted to a glass tube support 120. Glass tube support 120 of the present invention is similar to glass tube support 20 used in the prior art as shown in FIG. 1 and FIG. 2. The only difference is that there is a small hole 128 drilled near the depressed top 122 of support 120 and parallel to a prospective longitudinal direction of an elongated glass neon tube. Glass tube support 20 of the prior art can be easily converted into glass tube support 120 of the present invention by simply drilling a small hole 128 on prior art glass tube support 20. By way of example, the depth of hole 128 is about ¼ inch, and the distance from depressed top 122 to hole 128 is about ⅜ inch.

Referring to FIG. 4, there is shown clamping device 110 of the present invention. Clamping device 110 is made of resilient metal material with spring tension. By way of example clamping device 110 may be made of copper. Clamping device 110 has three portions: (1) pivot portion 112; (2) shaft portion 114 and (3) clamp portion 116. Shaft portion 114 and clamp portion 116 of clamping device 110 are in the same plane which is perpendicular to pivot portion 112 of clamping device 110. The length of pivot portion 112 of clamping device 110 is a little less than the depth of hole 128 on glass tube support 120. The length of shaft portion 114 of clamping device 110 is about the same as the distance from depressed top 122 to hole 128 of glass tube support 120. The shape of clamp portion 116 of clamping device 110 is generally little more than half of a hexagon. The size of clamp portion 116 of clamping device 110 is about the same as the outer diameter of the elongated glass neon tube, and may be varied to fit different glass neon tubes with different outer diameters.

Clamping device 110 is pivotally mounted to glass tube support 120 by inserting pivot portion 112 of clamping device 110 into hole 128 of glass tube support 120 as shown in FIG. 3. Shaft portion 114 of clamping device 110 can rotate about pivot portion 112 of clamping device 110 in a transversal plane which is perpendicular to the longitudinal direction of the elongated glass neon tube. In other words, clamping device 110 can be rotated about an axis parallel to the longitudinal direction of the elongated glass neon tube. When shaft portion 114 of clamping device 110 rotates away from the upward vertical position as shown in FIG. 3, clamping device 110 is in an open position which allows the elongated glass neon tube to be freely placed on or removed from glass tube support 120. Referring to FIG. 5, after elongated glass neon tube 10 is placed on depressed top 122 of glass tube support 120, shaft portion 114 of clamping device 110 can be rotated back to the upward vertical position so clamping device 110 is in a locking position, and clamp portion 116 of clamping device 110 encloses little more than half of the outer circumference of elongated glass neon tube 10 for retaining it onto glass tube support 120. A cross-sectional view of clamping device 110 in the locking position is shown in FIG. 6, where clamp portion 116 of clamping device 110 encloses little more than half of the outer circumference of elongated glass neon tube 10 and the spring tension of clamp device 110 holds elongated glass neon tube 10 securely onto depressed top 122 of glass tube support 120.

Figure 7:
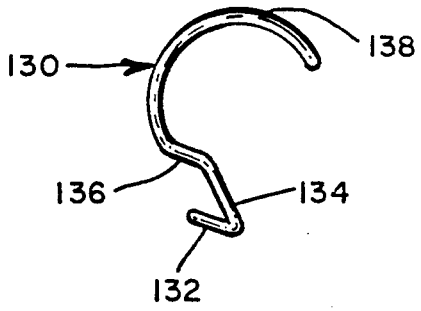
FIG. 7 is a perspective view of clamping device 130 of an alternative embodiment of the present invention.

In an alternative embodiment, the clamping device is configured in such a manner so that when it is clamped onto the glass neon tube, the clamp portion is in a plane perpendicular to the longitudinal direction of the glass neon tube crossing the center of the glass tube support. Referring to FIG. 7, there is shown clamping device 130 of an alternative embodiment of the present invention. Clamping device 130 is again made of resilient metal material with spring tension. By way of example clamping device 130 may be made of copper. Clamping device 130 has three portions: (1) pivot portion 132; (2) shaft portion with two segments 134 and 136; and (3) clamp portion 138. Segment 134 of shaft portion is perpendicular to pivot portion 132. Segment 136 of shaft portion is perpendicular to segment 134 of shaft portion and parallel to pivot portion 132. Segment 134 of shaft portion and clamp portion 138 are on two paralleled planes. The length of pivot portion 132 of clamping device 130 is little less than the depth of hole 128 on glass tube support 120. The length of segment 134 of shaft portion of clamping device 130 is about the distance from depressed top 122 to hole 128 of glass tube support 120 plus the radius of the glass tube to be supported. The length of segment 136 of shaft portion of clamping device 130 is about half of the thickness of the body of glass tube support 120. The shape of clamp portion 138 of clamping device 130 is generally little more than half of a hexagon. The size of clamp portion 138 of clamping device 130 is about the same as the outer diameter of the elongated glass neon tube, and may be varied to fit different glass neon tubes with different outer diameters.

Small hole 128 on glass tube support 120 may be a through hole. In this case the length of pivot portion 132 of clamping device 130 may be a little longer than the depth of the hole or the thickness of the body of glass tube support 120 so the free end of pivot portion 132 of clamping device 130 may be extended out from the other end of the small hole and bent a little bit so clamping device 130 will not get loose from glass tube support 120.

Figure 8:
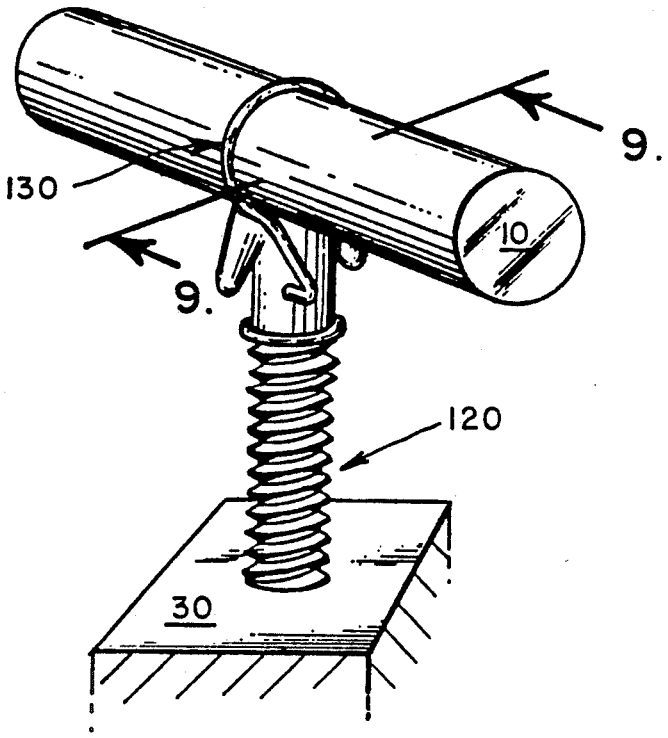
FIG. 8 is a perspective view showing an arrangement of the alternative embodiment of the present invention where clamping device 130 is rotated in a locking position for retaining the elongated glass neon tube 10 onto glass tube support 120.
Figure 9:
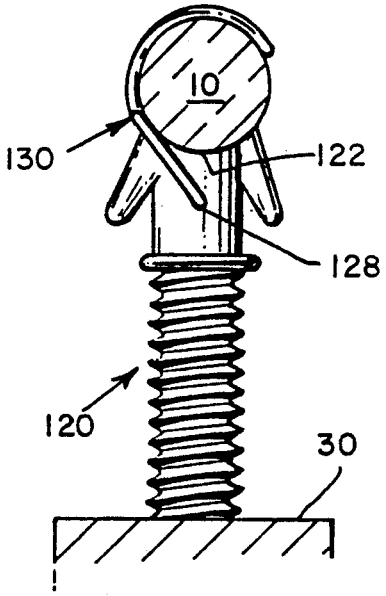
FIG. 9 is a cross-sectional view taken along line 9—9 of FIG. 8.

Clamping device 130 is pivotally mounted to glass tube support 120 by inserting pivot portion 132 of clamping device 130 into hole 128 of glass tube support 120. Segment 134 of shaft portion of clamping device 130 can rotate about pivot portion 132 of clamping device 130 in a transversal plane which is perpendicular to the longitudinal direction of the elongated glass neon tube. In other words, clamping device 130 can be rotated about an axis parallel to the longitudinal direction of the elongated glass neon tube. When clamping device 130 is rotated away from the upward vertical position, clamping device 130 is in an open position which allows the elongated glass neon tube to be freely placed on or removed from glass tube support 120. Referring to FIG. 8, after elongated glass neon tube 10 is placed on depressed top 122 of glass tube support 120, clamping device 130 can be rotated back toward the upward vertical position so clamping device 110 is in a locking position, and clamp portion 138 of clamping device 130 encloses little more than half of the outer circumference of elongated glass neon tube 10 for retaining it onto glass tube support 120. Because of segment 136 of the shaft portion is bent backward parallel to the longitudinal direction, clamping portion 138 of clamping device 130 is now at a plane perpendicular to the longitudinal direction of elongated glass neon tube 10 crossing the center of glass tube support 120, so that the tension applied on elongated glass neon tube 10 is located exactly at where glass tube support 120 supports elongated glass neon tube 10. This prevents the elongated glass neon tube from being bent by two opposite parallel forces from glass tube support 120 and clamp portion 138 of clamping device 130. A cross-sectional view of clamping device 130 in the locking position is shown in FIG. 9, where clamp portion 138 of clamping device 130 encloses little more than half of the outer circumference of elongated glass neon tube 10 and the spring tension of clamp device 130 holds elongated glass neon tube 10 securely onto depressed top 122 of glass tube support 120.

The above embodiments of the present invention are used with the glass tube supports which have been drilled with a small transverse hole, either entirely through the support or only partially through the support. The following alternative embodiments of the present invention discloses that with an additional piece of clamping member, the present invention can be used with glass tube supports without transverse holes. This alternative embodiment is useful because it cooperates with readily available glass tube supports currently used in commercial glass neon sign construction without any modification such as drilling a small hole.

Referring to FIG. 10, there is shown an alternative embodiment of the present invention. The clamping device comprises now a first clamping member 140 and a second clamping member 150. Clamping member 150 is generally the same shape as clamping member 110 and clamping member 130 as previously described with a little alteration in the folding angle between the shaft portion 154 and clamp portion 156. First clamping member 140 is generally U-shaped with two extended arms 142, each outwardly curved to fit the circumference of glass tube support 20. One embodiment of first clamping member 140 is made of copper wire. At the end of each arm wire 140 there are two small loops 144 for receiving the pivot portion 152 of second clamping member 150. These two small loops serves to replace small hole 128 drilled on glass tube support 120. Therefore currently available commercial glass tube supports with no holes can be used without any modification. A different embodiment of the U-shaped first clamping member is shown in FIG. 11 at 160. U-shaped first clamping member 160 is made of a thin piece of copper about, for example, ⅛" wide. There are two small holes 164 at the bases of the two extended arms 62 for receiving the pivot portion 152 of second clamping member 150. First clamping member 140 or 160 can be made of any kind of resilient metal material which has spring tension. FIG. 12 shows first clamping member 140 and second clamping member 150 are used together with a traditional glass tube support 20 for retaining glass tube 10 on glass tube support 20. First clamping member 140 is first clamped onto glass tube support 20 below the depressed top, then second clamping member 150 is pivotally attached to first clamping member 140 by inserting pivot portion 152 of second clamping member 150 into two small loops 144 of first clamping member 140. After glass tube 10 has been placed on top of glass tube support 20, second clamping member 150 is rotated to clamp onto glass tube 10 to retain it on glass tube support 20.

The present invention has many advantageous features including: (1) it is utilized with currently available glass tube supports but eliminates the time-consuming conventional wire fastening process; (2) it can be used to not only support the ends but also the middle portions or any location along an elongated glass neon tube; (3) it can be quickly engaged to a locking position for securely retaining the elongated glass neon tube onto the glass tube support; (4) it also can be quickly released to an open position to free the elongated glass neon tube; (5) it is made of strong durable material for long lasting repeatable use; and (6) it is inexpensive to produce since it is a fairly small piece.

Defined in detail, the present invention is a clamping device for retaining an elongated glass neon tube onto a glass tube support, comprising: (a) a glass tube support having a depressed top and a small hole parallel to the longitudinal direction of an elongated glass neon tube, where the depth of the small hole is about ¼ inch and the distance from the depressed top to the small hole is about ⅜ inch; (b) a clamping member made of a resilient metal wire with spring tension having a pivot portion, a shaft portion and a clamp portion, where the clamp portion is in a plane perpendicular to the pivot portion; (c) the size and shape of said clamp portion of said clamping member generally adapted to enclose about half of the outer circumference of the elongated glass neon tube; and (d) said pivot portion of said clamping member inserted into said small hole of said glass tube support so that said shaft portion and said clamp portion of said clamping member can be rotated about a longitudinal axis parallel to the elongated glass neon tube; (e) whereby when said clamp portion of said clamping member is rotated to an open position, the elongated glass neon tube can be freely placed on or removed from said depressed top of said glass tube support, and when said clamp portion of said clamping member is rotated to a locking position, said clamp portion of said clamping member is clamped onto about half of the outer circumference of the elongated glass neon tube with spring tension for retaining the elongated glass neon tube onto said depressed top of said glass tube support.

Also defined in detail, the present invention is a clamping device for retaining an elongated glass neon tube onto a glass tube support, comprising: (a) a glass tube support having a depressed top and a small hole parallel to the longitudinal direction of an elongated glass neon tube, where the depth of the small hole is about ¼ inch and the distance from the depressed top to the small hole is about ⅜ inch; (b) a clamping member made of a resilient metal wire with spring tension having a pivot portion, a shaft portion and a clamp portion, where the shaft portion and the clamp portion are in the same plane and perpendicular to the pivot portion; (c) the size and shape of said clamp portion of said clamping member generally adapted to enclose about half of the outer circumference of the elongated glass neon tube; and (d) said pivot portion of said clamping member inserted into said small hole of said glass tube support so that said shaft portion and said clamp portion of said clamping member can be rotated about a longitudinal axis parallel to the elongated glass neon tube; (e) whereby when said clamp portion of said clamping member is rotated to an open position, the elongated glass neon tube can be freely placed on or removed from said depressed top of said glass tube support, and when said clamp portion of said clamping member is rotated to a locking position, said clamp portion of said clamping member is clamped onto about half of the outer circumference of the elongated glass neon tube with spring tension for retaining the elongated glass neon tube onto said depressed top of said glass tube support.

In one of the preferred embodiments of the present invention defined in detail, the clamping member is made of copper, the length of the pivot portion of the clamping member is about the same as the depth of the small hole of the glass tube support, the length of the shaft portion of the clamping member is about the same as the distance from the depressed top to the small hole of the glass tube support, and the shape of the clamp portion of the clamping member is about half of a hexagon.

In another one of the preferred embodiments of the present invention defined in detail, the clamping member is made of copper, the length of the pivot portion of the clamping member is about the same as the depth of the small hole of the glass tube support, the shaft portion of the clamping member further comprises a first segment joined with and perpendicular to the pivot portion of the clamping member and a second segment parallel to the pivot portion of the clamping member, where the length of the first segment is about same as the distance from said depressed top to the small hole of the glass tube support plus the radius of the elongated glass neon tube to be retained by the glass tube support, and the shape of the clamp portion of the clamping member is about half of a circle.

Alternatively defined in detail, the present invention is a clamping device for retaining an elongated glass neon tube onto a glass tube support with a depressed top, comprising: (a) a generally U-shaped first member made of a resilient metal material with spring tension having a receiving means and clamped on the glass tube support at a location about ⅜ inch below the depressed top: (b) a second member made of a resilient metal wire with spring tension having a pivot portion, a shaft portion and a clamp portion, where the clamp portion is in a plane perpendicular to the pivot portion; (c) the size and shape of said clamp portion of said second member generally adapted to enclose about half of the outer circumference of the elongated glass neon tube; and (d) said pivot portion of said second member pivotally received by said receiving means of said first member such that said shaft portion and said clamp portion of said second member can be rotated about a longitudinal axis parallel to the elongated glass neon tube; (e) whereby when said clamp portion of said second member is rotated to an open position, the elongated glass neon tube can be freely put on or removed from the depressed top of the glass tube support, and when said clamp portion of said second member is rotated to a locking position, said clamp portion of said second member is clamped onto about half of the outer circumference of the elongated glass neon tube with spring tension for retaining the elongated glass neon tube onto the depressed top of the glass tube support.

Also alternatively defined in detail, the present invention is a clamping device for retaining an elongated glass neon tube onto a glass tube support with a depressed top, comprising: (a) a generally U-shaped first member made of a resilient metal material with spring tension having a receiving means and clamped on the glass tube support at a location about ⅜ inch below the depressed top; (b) a second member made of a resilient metal wire with spring tension having a pivot portion, a shaft portion and a clamp portion, where the shaft portion and the clamp portion are in the same plane and perpendicular to the pivot portion; (c) the size and shape of said clamp portion of said second member generally adapted to enclose about half of the outer circumference of the elongated glass neon tube; and (d) said pivot portion of said second member pivotally received by said receiving means of said first member such that said shaft portion and said clamp portion of said second member can be rotated about a longitudinal axis parallel to the elongated glass neon tube; (e) whereby when said clamp portion of said second member is rotated to an open position, the elongated glass neon tube can be freely put on or removed from the depressed top of the glass tube support, and when said clamp portion of said second member is rotated to a locking position, said clamp portion of said second member is clamped onto about half of the outer circumference of the elongated glass neon tube with spring tension for retaining the elongated glass neon tube onto the depressed top of the glass tube support.

In one of the alternative embodiments of the present invention the first member is made of copper wire and said receiving means are two aligned wire loops.

In another one of the alternative embodiments of the present invention the first member is made of elongated thin piece of copper about ⅛ inch wide and said receiving means are two aligned holes.

Defined broadly, the present invention is a clamping device for retaining an elongated glass neon tube onto a glass tube support, comprising: (a) a glass tube support with a transverse hole; (b) a clamping member made of resilient metal material having a pivot portion and a clamp portion which are perpendicular to each other; (c) the size and shape of said clamp portion of said clamping member is generally adapted to enclose about half of the outer circumference of said glass neon tube; and (d) said pivot portion of said clamping member is inserted into said transverse hole of said glass tube support so that said clamp portion of said clamping member can be rotated about a longitudinal axis parallel to the glass neon tube; (e) whereby when said clamp portion of said clamping member is rotated to an open position, the glass neon tube can be freely placed on or removed from said glass tube support, and when said clamp portion of said clamping member is rotated to a locking position, said clamp portion of said clamping member is clamped onto part of the outer circumference of the glass neon tube for retaining the glass neon tube onto said glass tube support.

Alternatively defined broadly, the present invention is a clamping device comprising: (a) a generally U-shaped first member made of a resilient metal with spring tension having a receiving means and clamped on a glass tube support; (b) a second member made of resilient metal material having a pivot portion and a clamp portion which are perpendicular to each other; (c) the size and shape of said clamp portion of said second member generally adapted to enclose part of the outer circumference of a glass neon tube; and (d) said pivot portion of said second member pivotally received by said receiving mean of said first member such that said clamp portion of said second member can be rotated about a longitudinal axis parallel to the glass neon tube; (e) whereby when said clamp portion of said second member is rotated to an open position, the glass neon tube can be freely placed on or removed from the glass tube support, and when said clamp portion of said second member is rotated to a locking position, said clamp portion of said second member is clamped onto part of the outer circumference of the glass neon tube for retaining the glass neon tube onto the glass tube support.

Defined more broadly, the present invention is a clamping device comprising: (a) a clamp made of resilient material having a first portion and a second portion; (b) said first portion of said clamp is pivotally mounted to a glass tube support; and (c) said second portion of said clamp is generally adapted to enclose part of the outer circumference of a glass tube; (d) whereby said second portion of said clamp can be rotated to a locking position to clamp onto part of the outer circumference of the glass tube for retaining the glass tube onto said glass tube support.

Alternatively defined more broadly, the present invention is a clamping device made of resilient material comprising: (a) a first member and a second member both made of resilient material; (b) said first member clamped to a glass tube support and said second member pivotally mounted to said first member; and (c) said second member having a clamp portion generally adapted to enclose part of the outer circumference of a glass tube; (d) whereby said clamp portion of said second member can be rotated to a locking position to clamp onto part of the outer circumference of the glass tube for retaining the glass tube onto the glass tube support.

Defined most broadly, the present invention is a clamping device comprising a first part mounted to a tube support and a second part generally adapted to enclose part of the outer circumference of a tube for retaining the tube onto the tube support.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A clamping device comprising:

a. a glass tube support with a transverse hole;

b. A clamping member made of resilient metal material having a pivot portion, a clamp portion and a shaft portion connecting the pivot portion and the clamp portion;

c. the size and shape of said clamp portion of said clamping member generally adapted to enclose part of the outer circumference of a glass neon tube;

d. said pivot portion of said clamping member inserted into said transverse hole of said glass tube support so that said clamp portion of said clamping member can be rotated about a longitudinal axis parallel to the glass neon tube; and e. said shaft portion of said clamping member further comprising a first segment joined with and generally perpendicular to said pivot portion of said clamping member, and a second segment generally parallel to said pivot portion of said clamping member;

f. whereby when said clamp portion of said clamping member is rotated to an open position, said glass neon tube can be freely placed on or removed from said glass tube support, and when said clamp portion of said clamping member is rotated to a locking position, said clamp portion of said clamping member is clamped onto part of the outer circumference of said glass neon tube for retaining said glass neon tube onto said glass tube support.

2. The invention as defined in claim 1 wherein said clamping member is made of copper.

3. The invention as defined in claim 1 wherein the shape of said clamp portion of said clamping member is about half of a circle.

4. The invention as defined in claim 1 wherein the shape of said clamp portion of said clamping member is about half of a hexagon.

5. A clamping device for retaining an elongated glass neon tube onto a glass tube support, comprising:

a. a glass tube support having a depressed top and a small hole parallel to the longitudinal direction of an elongated glass neon tube, where the depth of the small hole is about ¼ inch and the distance from the depressed top to the small hole is about ⅜ inch;

b. a clamping member made of a resilient metal wire with spring tension having a pivot portion, a shaft portion and a clamp portion, where the clamp portion is in a plane perpendicular to the pivot portion;

c. the size and shape of said clamp portion of said clamping member generally adapted to enclose about half of the outer circumference of said elongated glass neon tube;

d. said pivot portion of said clamping member inserted into said small hole of said glass tube support so that said shaft portion and said clamp portion of said clamping member can be rotated about a longitudinal axis parallel to said elongated glass neon tube; and e. said shaft portion of said clamping member further comprising a first segment joined with and perpendicular to said pivot portion of said clamping member, and a second segment parallel to said pivot portion of said clamping member, where the length of the first segment is about same as the distance from said depressed top to said small hole of said glass tube support plus the radius of said elongated glass neon tube to be retained by said glass tube support;

f. whereby when said clamp portion of said clamping member is rotated to an open position, said elongated glass neon tube can be freely put on or removed from said depressed top of said glass tube support, and when said clamp portion of said clamping member is rotated to a locking position, said clamp portion of said clamping member is clamped onto about half of the outer circumference of said elongated glass neon tube with spring tension for retaining said elongated glass neon tube onto said depressed top of said glass tube support.

6. The invention as defined in claim 5 wherein said clamping member is made of copper.

7. The invention as defined in claim 5 wherein the length of said pivot portion of said clamping member is about the same as the depth of said small hole of said glass tube support.

8. The invention as defined in claim 5 wherein the shape of said clamp portion of said clamping member is about half of a hexagon.

9. The invention as defined in claim 5 wherein the shape of said clamp portion of said clamping member is about half of a circle.

10. A clamping device for retaining an elongated glass neon tube onto a glass tube support, comprising:

a. a glass tube support having a depressed top and a small hole parallel to the longitudinal direction of an elongated glass neon tube, where the depth of the small hole is about ¼ inch and the distance from the depressed top to the small hole is about ⅜ inch;

b. a clamping member made of a resilient metal wire with spring tension having a pivot portion, a shaft portion and a clamp portion, where the clamp portion is in a plane perpendicular to the pivot portion;

c. the size and shape of said clamp portion of said clamping member generally adapted to enclose about half of the outer circumference of said elongated glass neon tube;

d. said pivot portion of said clamping member inserted into said small hole of said glass tube support so that said shaft portion and said clamp portion of said clamping member can be rotated about a longitudinal axis parallel to said elongated glass neon tube;

e. said shaft portion of said clamping member further comprising a first segment joined with and perpendicular to said pivot portion of said clamping member, and a second segment parallel to said pivot portion of said clamping member, where the length of the first segment is about same as the distance from said depressed top to said small hole of said glass tube support plus the radius of said elongated glass neon tube to be retained by said glass tube support; and f. the shape of said clamp portion of said clamping member is about half of a hexagon;

g. whereby when said clamp portion of said clamping member is rotated to an open position, said elongated glass neon tube can be freely put on or removed from said depressed top of said glass tube support, and when said clamp portion of said clamping member is rotated to a locking position, said clamp portion of said clamping member is clamped onto about half of the outer circumference of said elongated glass neon tube with spring tension for retaining said elongated glass neon tube onto said depressed top of said glass tube support.

11. The invention as defined in claim 10 wherein said clamping member is made of copper.

12. The invention as defined in claim 10 wherein the length of said pivot portion of said clamping member is about the same as the depth of said small hole of said glass tube support.

13. A clamping device for retaining an elongated glass neon tube onto a glass tube support, comprising:

a. a glass tube support having a depressed top and a small hole parallel to the longitudinal direction of an elongated glass neon tube, where the depth of the small hole is about ¼ inch and the distance from the depressed top to the small hole is about ⅜ inch;

b. a clamping member made of a resilient metal wire with spring tension having a pivot portion, a shaft portion and a clamp portion, where the clamp portion is in a plane perpendicular to the pivot portion;

c. the size and shape of said clamp portion of said clamping member generally adapted to enclose about half of the outer circumference of said elongated glass neon tube;

d. said pivot portion of said clamping member inserted into said small hole of said glass tube support so that said shaft portion and said clamp portion of said clamping member can be rotated about a longitudinal axis parallel to said elongated glass neon tube;

e. said shaft portion of said clamping member further comprising a first segment joined with and perpendicular to said pivot portion of said clamping member, and a second segment parallel to said pivot portion of said clamping member, where the length of the first segment is about same as the distance from said depressed top to said small hole of said glass tube support plus the radius of said elongated glass neon tube to be retained by said glass tube support; and f. the shape of said clamp portion of said clamping member is about half of a circle;

g. whereby when said clamp portion of said clamping member is rotated to an open position, said elongated glass neon tube can be freely put on or removed from said depressed top of said glass tube support, and when said clamp portion of said clamping member is rotated to a locking position, said clamp portion of said clamping member is clamped onto about half of the outer circumference of said elongated glass neon tube with spring tension for retaining said elongated glass neon tube onto said depressed top of said glass tube support.

14. The invention as defined in claim 13 wherein said clamping member is made of copper.

15. The invention as defined in claim 13 wherein the length of said pivot portion of said clamping member is about the same as the depth of said small hole of said glass tube support.

* * * * *